United States Patent [19]

Lechelle et al.

[11] Patent Number: 4,839,978

[45] Date of Patent: Jun. 20, 1989

[54] SUPPORT DEVICE FOR THE MECHANISM OF A REVOLVER

[75] Inventors: Alain Lechelle; Thierry Guidat, both of Mulhouse; Serge Bruckert, Cernay, all of France

[73] Assignee: Matra Manurhin Defense, France

[21] Appl. No.: 171,716

[22] Filed: Mar. 22, 1988

[30] Foreign Application Priority Data

Mar. 23, 1987 [FR] France ..... 87 03978

[51] Int. Cl.[4] ..... F41C 1/00

[52] U.S. Cl. ..... 42/65

[58] Field of Search ..... 42/65, 58, 59

[56] References Cited

U.S. PATENT DOCUMENTS

| | | | |
|---|---|---|---|
| 2,640,396 | 6/1953 | Grebey | 89/184 |
| 2,659,172 | 11/1953 | Parry | 42/57 |
| 2,927,390 | 3/1960 | Lewis | 42/65 |
| 3,024,559 | 3/1962 | Weatherby | 42/70 |
| 3,548,530 | 12/1970 | Röhm | 42/65 |
| 3,654,720 | 4/1972 | Ruger | 42/65 |
| 3,810,326 | 5/1974 | HIllberg et al. | 42/59 |
| 4,213,263 | 7/1980 | Brouthers | 42/59 |
| 4,641,449 | 2/1987 | Kapland et al. | 42/65 |

FOREIGN PATENT DOCUMENTS

| | | |
|---|---|---|
| 2487062 | 1/1982 | France . |
| 731093 | 6/1955 | United Kingdom . |

*Primary Examiner*—Deborah L. Kyle
*Assistant Examiner*—Michael J. Carone
*Attorney, Agent, or Firm*—Pollock, Vande Sande & Priddy

[57] ABSTRACT

A device for supporting the mechanism of a revolver in association with the frame of the revolver. The device is constituted by a mechanism carrier plate (1) which directly receives the various subassemblies (4, 13, 24, 30, 35) of the mechanism, and which is capable of being mounted directly, together with the subassemblies supported thereby, on the frame (2) of the revolver.

18 Claims, 7 Drawing Sheets

FIG. 21
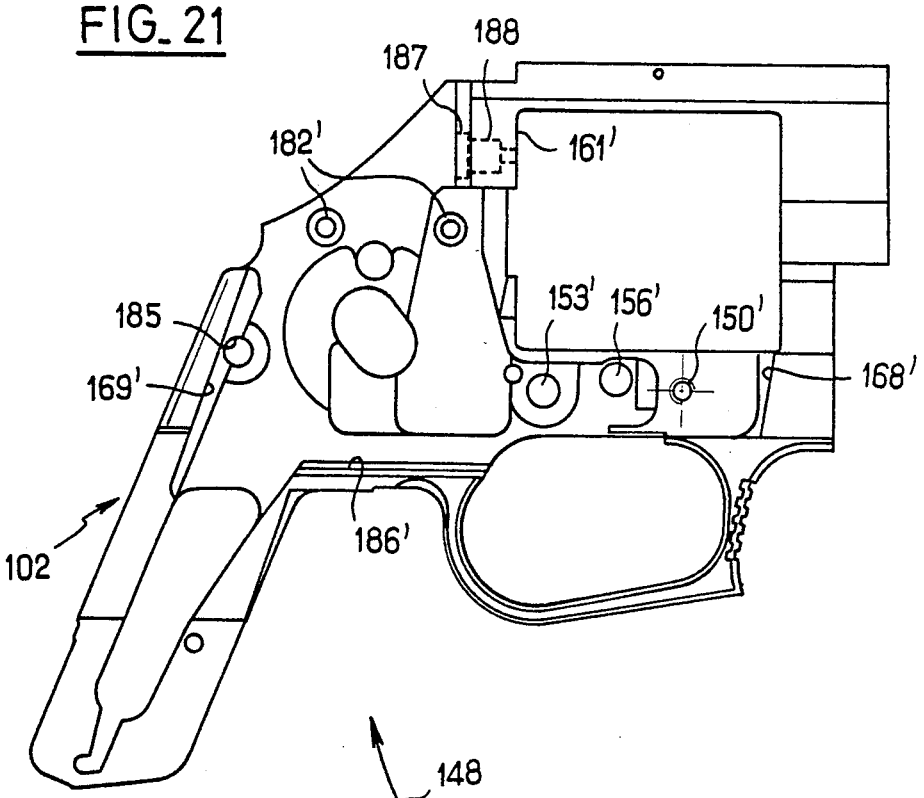
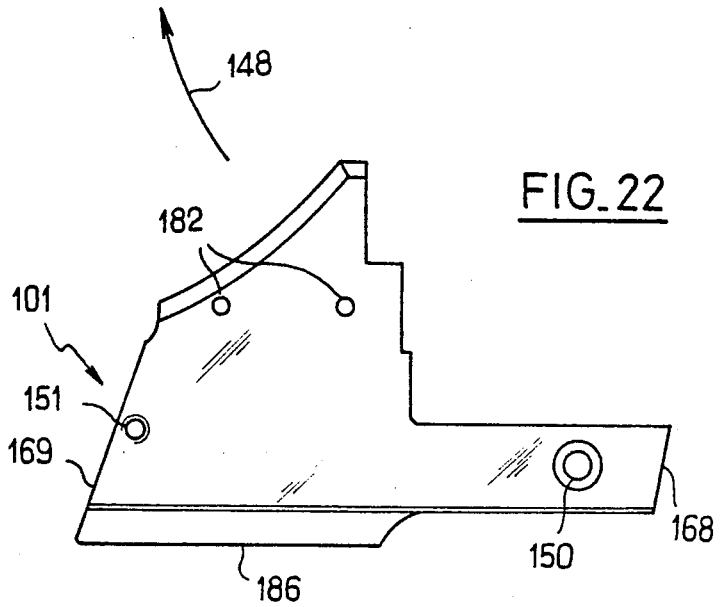
FIG. 22

SUPPORT DEVICE FOR THE MECHANISM OF A REVOLVER

The present invention relates to revolvers, and more particularly to a revolver mechanism support constituted by a device which is associated with the frame of said revolver.

BACKGROUND OF THE INVENTION

In a first type of design, proposals have been made to confer the function of supporting the mechanism to the revolver frame alone. In this case, the revolver frame constituting the master component of the gun is machined so that it can itself support the various moving parts: said frame then constitutes a housing containing all the important moving parts and withstanding the various forces that occur on firing, with said housing being closed by a simple lid constituting a cover plate.

Such a design suffers from several drawbacks.

Firstly, during manufacture, the frame constitutes a part which is expensive because of the various different machining operations which must be performed, and in particular the difficulties of machining various passages which are difficult of access and therefore require special tools. It must be understood that precision machining is essential for proper operation of the mechanism, in particular where it determines the positions of the various cross pivots or pins of the mechanism and thus the associated distances therebetween.

In addition, it is difficult to adjust the mechanism because of the poor accessibility of the various parts of said mechanism.

Finally, the mechanism is constituted by individual parts mounted one after the other on the frame on the gun, rather than in the form of functional subassemblies capable of being separately adjusted and/or replaced: as a result there is very little room for interchangability in the full set of moving parts. U.S. Pat. No. 3,548,530 may be mentioned as illustrating a revolver frame having a mechanism receiving housing which is closed by a cover plate. This cover plate serves as a lid and does not support the gun mechanism; said plate merely has two bores serving as bearings for the hammer pivot and the trigger pivot, in entirely conventional manner, with the special feature of the mechaism described lying in the hammer and the trigger being made by casting under pressure and by the associated pivots being force-fitted.

In a second type of design, proposals have been made to collect some of the parts of the mechanism together by mounting them on the trigger guard of the revolver, said guard then constituting a mechanism carrying add-on part. Such a design is illustrated, for example, in U.S. Pat. No. 3,654,720. The guard receives the trigger and various parts of the mechanism (essentially the cylinder pawl and the striker plate lever).

Although this design may simplify the operations of assembling or replacing the functional subassembly carried by the guard, it is even more difficult with respect to the degree of machining accuracy required: in particular the important distance between the hammer and the trigger requires very high precision. Indeed, this design is even less satisfactory when it comes to adjustment operations because of the trigger guard plate being mounted blind.

Proposals have been made to improve this design somewhat by defining the distance between the hammer and the trigger on a single part, for example as shown in U.S. Pat. No. 4,213,263. However, in spite of the improved accuracy thus obtained, this design does nothing to reduce the difficulty of machining, and it does not make it possible to check the relationship between the mechanism and the cylinder. Naturally, the same drawbacks as mentioned above still apply with respect to difficulty of performing adjustment.

Thus, this second type of design with a partial subassembly mounted on an add-on trigger guard necessarily requires very high machining accuracy for mounting on the frame, and is hardly satisfactory for performing maintenance operations: in any event adjustment remains difficult, in particular since the operation of the mechanism cannot be seen when the gun is assembled (indeed, technicians are often obliged to make additional openings in sample pieces in order to be able to observe the mechanism).

A design has also been proposed which lies halfway between the two above-mentioned designs, having a one-piece grip-and-trigger-guard assembly which serves as a mechanism carrier. This is illustrated, for example, in U.S. Pat. No. 3,810,326 or in French Pat. No. 2,487,062.

The assembly described in U.S. Pat. No. 3,810,326 is more satisfactory than that mentioned above, as described in U.S. Pat. No. 3,654,720, insofar as means are provided for integrating the members acting as a cylinder latch or stop (part reference number 18) in with the assemblies for driving the hammer and the trigger. However, the grip-and-guard assembly must be capable of being machined with great accuracy and merely by observing the structure of this assembly with its central channel for receiving the various parts of the mechanism it will be understood that the operations of machining this assembly and the operations of adjusting the mechanism (which can be reached only through the central channel that does not have any side openings) are difficult.

It should also be observed that this last-mentioned halfway design suffers from an additional drawback which may have major consequences in operation, said drawback concerning the assembly of the cylinder pawl, i.e. the index level which rotates the cylinder (reference 22 in U.S. Pat. No. 3,810,326). The cinylinder pawl is guided solely by the adjacent region of the frame by being received in a groove therein: as a result, if the pawl is to be properly positioned transversely, the frame-forming grip-and-guard assembly must be very accurately machined, which is difficult to do because of the very structure of said assembly. In operation, the consequence of faulty transverse positioning of the cylinder pawl is to cause the cylinder to rotate either too much or else too little.

Additional items of the state of the art that may be mentioned include: British Pat. No. 731,093, and U.S. Pats. Nos. 4,641,449; 3,024,559; 2,927,390; 2,640,396, and 2,659,172. It may be observed that the last-mentioned patent concerns a child's toy (a pistol for use with a strip of caps, with the pivots for the hammer and the trigger being mounted on a frame which also constitutes the grip).

The object of the invention is to provide a support device for a revolver mechanism which is more effective than the above-described prior devices, and in particular which facilitates the operations of manufacture and assembly, thereby also making it possible to reduce manufacturing costs.

Another object of the invention is to improve accessibility for adjustment and/or inspection and/or assembly, and in particular to make it possible to automate assembly, and also to make it possible to interchange an entire set of moving parts.

Another object of the invention is to provide a support device which facilitates proper transverse positioning of various moving parts of the mechanism, and in particular of the cylinder pawl, by virtue of easily-obtained accurate lateral guidance.

SUMMARY OF THE INVENTION

More particularly, the present invention provides a device for supporting the mechanism of a revolver in association with the frame of said revolver, the device being characterized by the fact that it is essentially constituted by a mechanism carrier plate, said plate firstly directly receiving various subassemblies of the mechanism, including a first subassembly associated with the hammer, a second subassembly associated with the trigger, and a third subassembly associated with the cylinder latch, said plate secondly being capable of being directly mounted together with the subassemblies supported thereby on the frame of the revolver.

In a first variant of the support device in accordance with the invention, the mechanism carrier plate also receives a fourth subassembly associated with the firing pin.

Provision may also be made for the mechanism carrier plate also to receive a fifth subassembly associated with the cylinder release.

In a particular embodiment, the mechanism carrier plate includes transverse reference facettes, which are associated with tranverse bearing surfaces provided on the revolver frame, thereby enabling said plate together with the subassemblies carried thereby to be positioned exactly on said frame.

Preferably, and in accordance with an embodiment which is particularly advantageous from the technical point of view, the mechanism carrier plate directly receives the various subassemblies of the mechanism on the same inside face, with the outside face of the plate extending the corresponding side face of the frame such that said plate also constitutes a cover plate.

Advantageously, the mechanism carrier plate has a stepped projecting block at the top and on its inside, with a first portion of the block adjacent to the inside face of the plate serving to receive the fourth assembly associated with the firing pin, and with a second portion thereof coming into abutment via its rear face against the frame when said plate is mounted thereon, the front face of said projecting block providing backing for the revolver cylinder and for the cartridge being fired; in particular, for a revolver whose mechanism includes a fifth subassembly associated with the cylinder release, the projecting block may carry a one-piece shelf projecting rearwardly, said sheld being suitable firstly for directly receiving said subassembly associated with the cylinder release, and secondly, when said plate is mounted in the frame, for supporting a release button enabling the cylinder release to be removed from the outside.

Preferably, the rear face of the second portion of the projecting block constitutes one of the transverse reference facettes, with the other two facettes being constituted by the two end edges of the plate; further it is advantageous for the inside face of the first portion of the projecting block to constitute a bearing surface, whereby the plate together with the subassemblies it supports, may be positioned to bear against the frame.

Advantageously, the mechanism carrier plate has, on its inside, a plane center region which is set-back relative to a plane face from which the stepped projecting block projects, thereby defining a guide slot for providing transverse positioning for at least some of the members of the mechanism, and in particular for the cylinder drive pawl; in particular, in side view, the said plate is generally L-shaped, with the set-back center region also being generally L-shaped, and with both L-shapes sharing a common right angle.

Preferably, the mechanism carrier plate has a plurality of holes in its inside face which holes extend substantially perpendicularly to said inside face, said holes being for the purpose of supporting the main pivots and pins of the mechanism, in particular the hammer pivot, the trigger pivot, and the cylinder latch pivot, with the holes associated with the hammer and the trigger pivots being preferably blind holes.

It is also advantageous for the projecting block of the mechanism carrier plate to include a plurality of holes extending substantially to the inside face of said plate, said holes serving to receive longitudinally slidable members, in particular the firing pin, the axial pin of the cylinder and the adjacent tongue of the cylinder release, and the pin for the release button; in particular, the axes of said holes occupy two orthogonal reference planes which intersect on the axis of the cylinder.

In a second variant, the support device in accordance with the invention is associated with a revolver frame which receives a subassembly associated with the striker, in which case the mechanism carrier plate has a projecting block near its top and on its inside face, with the front face of the block constituting a backing face for the cylinder of the revolver. In particular, the projecting block defines, together with the frame a space for passing the end of the cylinder pawl which, in this case, is disposed between the revolver trigger and said frame.

In this type of variant, it is advantageous for th e mechanism carrier plate to include a plurality of holes on its inside face, said holes extending substantially perpendicularly to said inside face and serving to support the main pivots and pins of the mechanism, and in particular the hammer pivot, the trigger pivot, and the cylinder latch pivot, and preferably also a pin serving as a bearing surface for the return spring of the revolver trigger.

Finally, it is preferably, in either of the above-specified variants, for the mechanism carrier plate to support a side piece on its outside face, said side piece acting as a backing face for cartridges, said side piece being added to said plate so that the outside face of said plate is plane for facilitating the operations of machining the plate and of mounting and/or adjusting the various subassemblies of the mechanism which are mounted directly on said plate.

BRIEF DESCRIPTION OF THE DRAWINGS

Embodiments of the invention are described by way of example with reference to the accompanying drawings, in which:

FIG. 21 is a fragmentary side view of the revolver frame; and

FIG. 22 is a corresponding view of the above-mentioned plate for showing how the transverse facettes ensure that the plate is accurately positioned on the frame.

DESCRIPTION OF PREFERRED EMBODIMENT

Figure 1:
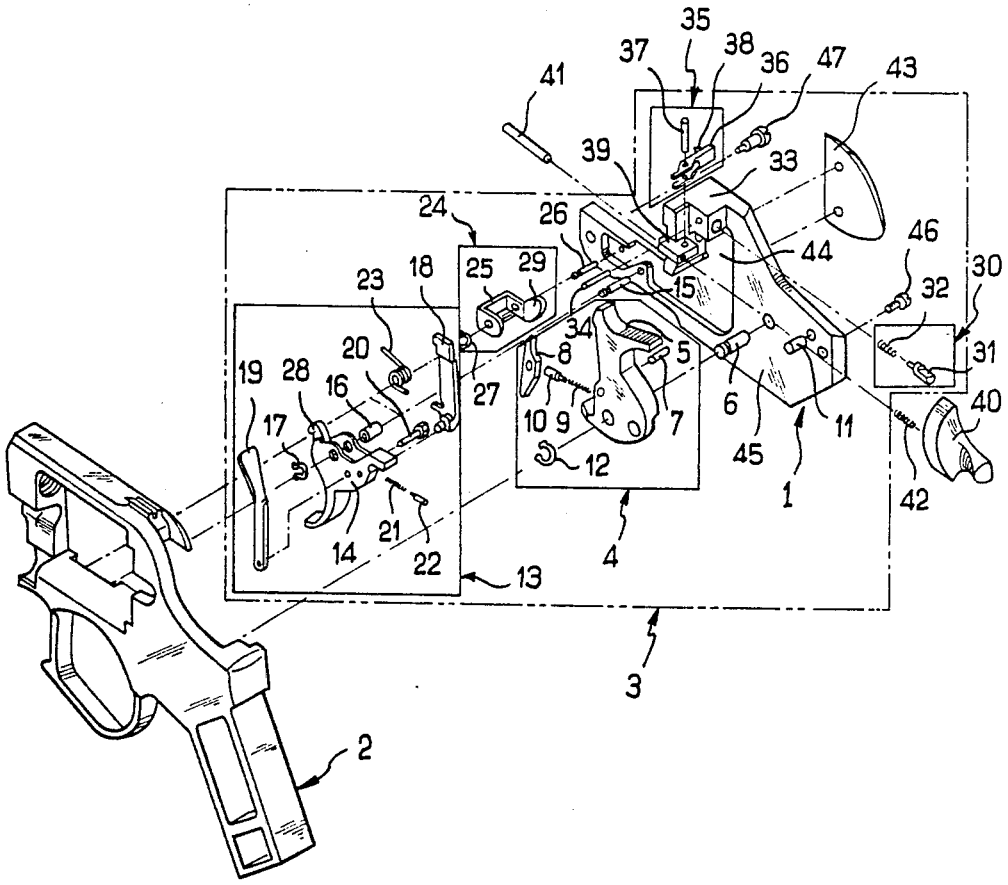
FIG. 1 is an exploded perspective view showing a mechanism carrier plate in accordance with a first variant of the invention together with functional subassemblies associated with the hammer, with the trigger, with the cylinder latch, and also in this case, with the striker and with the cylinder release, and with the entire assembly being capable of being assembled directly on the frame of a revolver.

The exploded view of FIG. 1 shows a support device for a revolver mechanism associated with the frame of said revolver and made in accordance with the present invention.

This support device is essentially constituted by a mechanism carrier plate 1, said plate directly receiving the various subassemblies of the mechanism and being itself suitable for being directly mounted together with the subassemblies carried thereby on the frame 2 of the revolver.

The exploded view of the figure shows a revolver mechanism comprising a plurality of functional subassemblies with all of the moving parts being shown together inside dot-dashed line box 3. However, it should be understood that the present invention is not limited to particular types of functional subassemblies, and that the particular subassemblies shown are shown by way of example. The essential feature of the invention lies in the fact that the mechanism carrier plate receives the various functional subassemblies directly, thereby providing very favorable accessibility for the operations of machining, assembly, and adjustment.

Thus, the set of moving parts 3 comprises a plurality of subassemblies which are described below in brief, given that the general structure of the component parts is conventional in design. The first assembly, referenced 4 is associated with the hammer. This assembly comprises a hammer 5 capable of pivoting about a pivot 6 and carrying a pivot 7 on which a cocking dog 8 is pivoted. The dog 8 is permanently biased by a spring 9 via a pusher 10. In addition to the hammer pivot 6 which is mounted on the mechanism carrier plate in a manner described below, it should also be mentioned that the plate also carries a pin 11 which serves as a rear abutment for the hammer 5. Finally, the hammer 5 is held on its pivot 6 by any conventional means, e.g. a spring clip 12.

Figure 2:
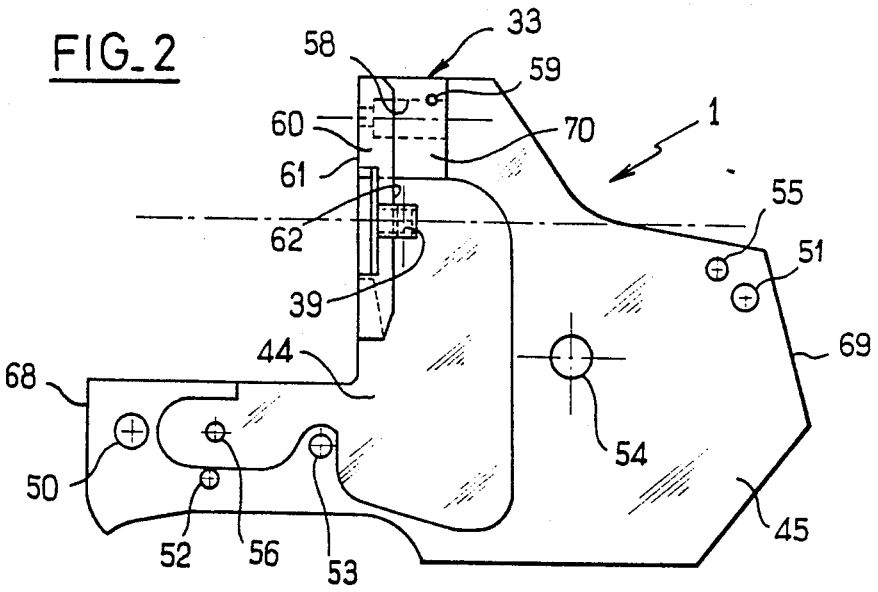
FIG. 2 is a side view, on a larger scale, or the above mechanism carrier plate.
Figure 3:
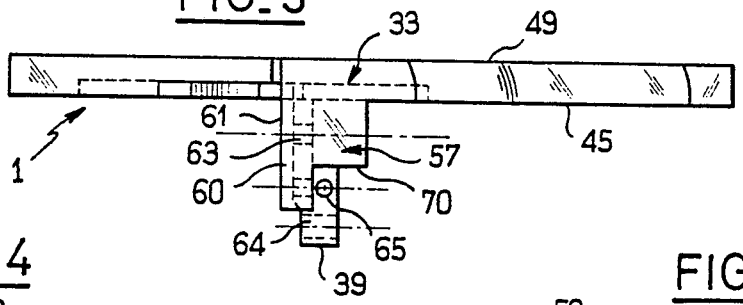
FIGS. 3 to 5 are respectively a plan view and opposite end views of the plate shown in FIG. 2.
Figure 4:
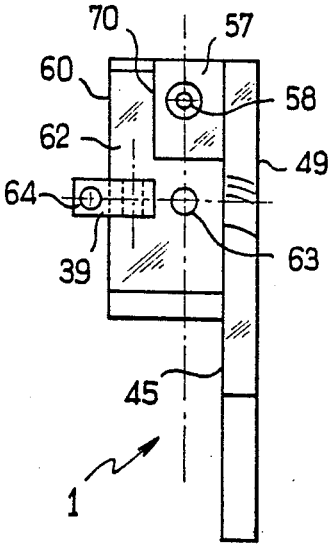

The second assembly 13 is associated with the trigger. It comprises the trigger per se 14 mounted on a pivot 15 by means of a bush 16 and a spring clip 17. As explained below, the pivot 15 is mounted directly on the mechanism carrier plate 1. On either side of the trigger 14 there are the cylinder pawl 18 (i.e. the lever which engages the ejector ratchet, not shown), and the striker lever 19 which pivots about a pivot 20. The cylinder pawl 18 is biased by a spring 21 via an associated pusher 22. A return spring 23 which serves to return the trigger has one branch pressing against said trigger and has its other branch pressing against a pin mounted directly on the mechanism carrier plate (and visible only in FIG. 2).

The third assembly 24 is associated with the cylinder latch. It comprises a cylinder latch 25 mounted to pivot on a pivot 26 which is mounted directly on the mechanism carrier plate 1 in a manner described below. Said latch is held in place on its pivot by means of a spring clip 27. The cylinder latch 25 is generally U-shaped with the nose 28 of the trigger 14 passing between the branches of the U. One of the branches of the latch has a projection 29 capable of projecting from said plate for co-operating with a notch provided for this purpose in the cylinder (not shown in order to avoid overloading the drawing). This will be better understood from the detailed description of the mechanism carrier plate given below with reference to FIGS. 2 to 7.

The fourth assembly 30 is associated with the firing pin. Thus, there is a sliding type firing pin 31 which is mounted together with its spring 32 in a bore in the mechanism carrier plate 1, or more precisely in a stepped block 33 projecting from said plate. The firing pin is held in its housing in an entirely conventional manner by a transverse pin 34 which is mounted in a transverse bore through the mechanism carrier plate. Finally, there may be fifth assembly 35 associated with the cylinder released. It is conventional to provide means for latching the cylinder to the frame once the cylinder has been loaded in the swung-out position. This latching is provided either at the rear of the cylinder by means of a cylinder release which slides longitudinally or which is mounted to pivot, or else it is provided at the fornt of the cylinder by latching means associated with the cylinder crane. In the present case, the revolver is fitted with a cylinder release 36 pivotably mounted on a pivot 37 and having a tongue 38 suitable for co-operating with the axial pin of the cylinder for releasing it. The pivot 37 is mounted on a shelf 39 integral with the projecting block 33 on the mechanism carrier plate. A portion of the functional assembly associated with the cylinder release is mounted directly on the mechanism carrier plate prior to the plate being mounted on the revolver frame. Thus, a release button 40 is put into place solely at the end of assembly so as to slide over the sheld 39 along a pin 41 mounted in a bore in said sheld, said release button being biased by an associated spring 42 which urges said release button forwardly so that the front face thereof constitutes a portion of the revolver backing face.

The detailed structure of the cylinder release 36 and of the release button 40 will be better understand on referring to FIGS. 8 to 11 for the member 40, and to FIGS. 12 to 15 for the member 36.

It can thus be understood that the mechanism carrier plate 1 is made easier to machine by the side piece 43 which acts as a backing face for the cartridges being subsequently added to the plane outer face of said plate, thereby facilitating assembly of the various functional subassemblies 4, 13, 24, 30, and 35 on the mechanism carrier plate with optimal accessibility which considerably facilitates the operations of assembly and adjustment.

It should also be observed in FIG. 1 that the carrier plate has a plane center region 44 set back from its plane inside face 45 from which the stepped block 33 projects, thereby defining a guidance groove which ensures that at least some of the parts of the mechanism are accurately positioned transversely, and in this case, in particular, that the cylinder drive pawl 18 is accurately positioned, given that any error in the positioning of this pawl gives rise, in operation, to the cylinder rotating either too much or too little. This improvement in the transverse positioning thus provides an important advantage over period techniques as described above.

Thus, once the various functional subassemblies have been mounted on the mechanism carrier plate, the entire assembly can be mounted directly on the frame 2 and fixed thereto by means of screws 46 and 47.

The detailed structure of the mechanism carrier plate 1 which serves both for mounting the various functional subassemblies and for positioning the fully equipped plate on the frame, is now described with reference to FIGS. 2 to 7.

FIGS. 2 to 5 show the exact structure of the one-piece mechanism carrier plate in detail. In side view, the mechanism carrier plate is generally L-shaped and it is suitable for directly receiving the various subassemblies of the mechanism on the same inside face. The outside face 49 of the plate extends the corresponding side face of the frame 2 such that said mechanism carrier plate also constitutes a cover plate. The set-back center region 44 is also generally L-shaped, and its angle is common with the angle of the L-shaped of the plate as a whole. The set-back center region 44 serves as a bearing surface for the cylinder pawl 18 and also for one of the branches of the cylinder latch 25.

On the plane face 45 of the mechanism carrier plate there are: two holes 50 and 51 for receiving respective fixing screws 47 and 46; together with a plurality of blind holes for receiving the various pivots and pins which extend generally perpendicular to said plane of the plate. Thus there is a hole 52 associated with a pin (not shown) serving as an abutment for the outside branch of the trigger return spring 23; a blind hole 53 receiving the trigger pivot 15; a blind hold 54 receiving the hammer pivot 6; and a blind hole 55 receiving the rear abutment 11 for the hammer. A hole 56 is provided for the cylinder latch pivot 26; however, given the thinness of the set-back center region 44, it is preferably for this hole 56 to be a through-hole like the holes 50 and 51 as can be seen in the FIG. 7 view which shows the outside face of the mechanism carrier plate.

On its inside and near the top, the mechanism carrier plate 1 has a stepped projecting block 33 having a first portion 57 adjacent to the inside face 45 of the plate for receiving the fourth assembly 30 associated with the firing pin. A stepped longitudinal bore 58 can be seen for receiving the firing pin 31 and its spring 32, and there is also a blind transverse hole 59 for receiving the stop pin 34 associated with the firing pin.

The stepped projecting block 33 includes a second portion 60 which is substantially in the form of a transverse plate and whose front face coincides with the front face 61 of the projecting block 33, thus constituting a backing face for the cylinder and the cartridge being fired. The rear face 62 of said second portion 60 is intended to bear against the frame when the mechanism plate is mounted thereon, as can be seen clearly in FIGS. 6 and 7.

The second portion 60 of the stepped projecting block 33 also includes a central bore 63 for receiving the end of the cylinder's axial pin (and also for passing the tongue 38 of the cylinder release 36). This portion also carries a one-piece shelf 39 projecting rearwardly, as mentioned above. This one-piece sheld carries a first longitudinal bore 64 receiving the pin 41 of the release button 40 and a bore 65 orthogonal to the first bore 64 and receiving the pivot 37 of the cylinder release 36. Thus, said shelf can firstly directly receive the subassembly 35 associated with the cylinder release, and can secondly serve to support the release button 40 (once the plate has been mounted on the frame), thereby enabling the motion of the cylinder release 36 to be controlled from the outside. It is also possible to provide a tapped hole instead of the bore 64 in order to receive the end of the pin 41 which would be threaded in this case, thereby facilitating retention of said pin.

Figure 5:
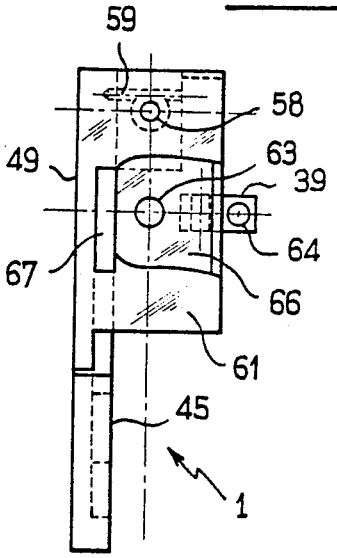

The front face 61 of the mechanism carrier plate must be capable of performing two backing functions, and reference should be made to FIG. 5 where this face is more visible. A central portion 66 is provided on a plane which is slightly set-back relative to the front face 61. This set-back portion 66 surrounds the bore 63 for receiving the axial pin of the cylinder and continues up to a slot 67 provided to pass the end of the cylinder pawl 18. Thus, the front face of the plate performs two functions: its region surround the firing pin bore 58 provides a backing function for the cartridge being fired, and its region surround the bore 63 on the cylinder axis provides a backing function for the cylinder (regardless of whether this region is set-back or not).

The above description shows how the various functional subassemblies associated with the hammer, the trigger, the cylinder latch, the firing pin, and optionally the cylinder release button may be mounted directly on the mechanism carrier plate 1. Mounting these subassemblies on a common plate provides a considerable advantage in accuracy since the mechanism carrier plate itself provides a single dimensional reference. Naturally, precautions must be taken to avoid spoiling the precision obtained by badly positioning an equipped plate on the frame on the revolver.

Figure 6:
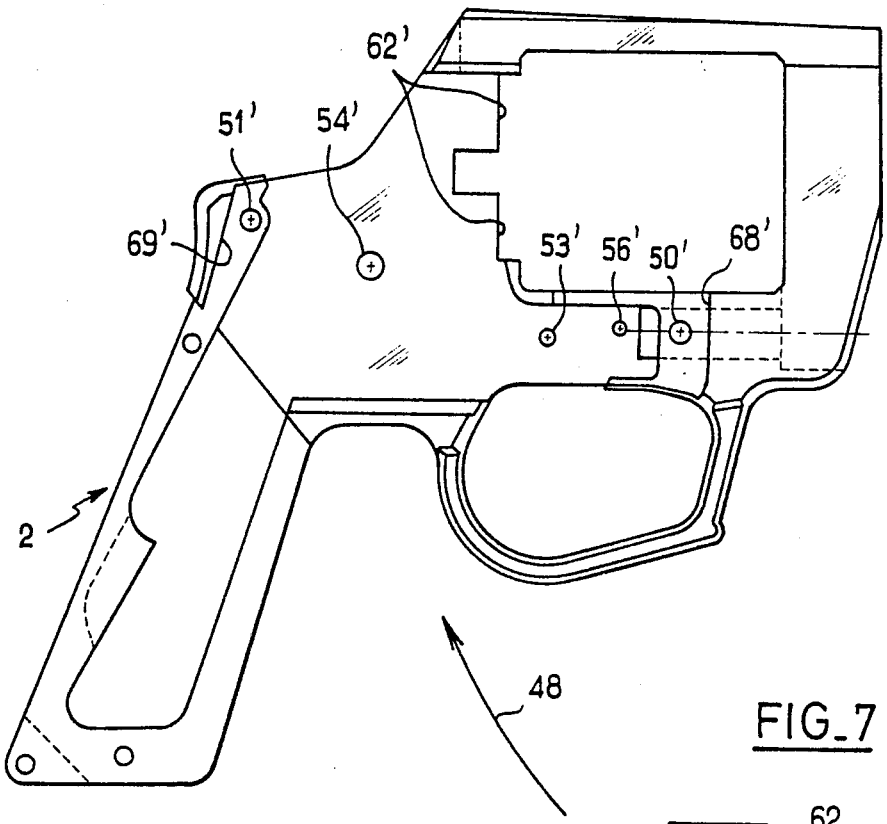
FIG. 6 is a fragmentary side view of the frame of the revolver and FIG. 7 is a corresponding view of the above-mentioned plate, thereby clearly showing up the transverse facettes which ensure that said plate is accurately positioned.
Figure 7:
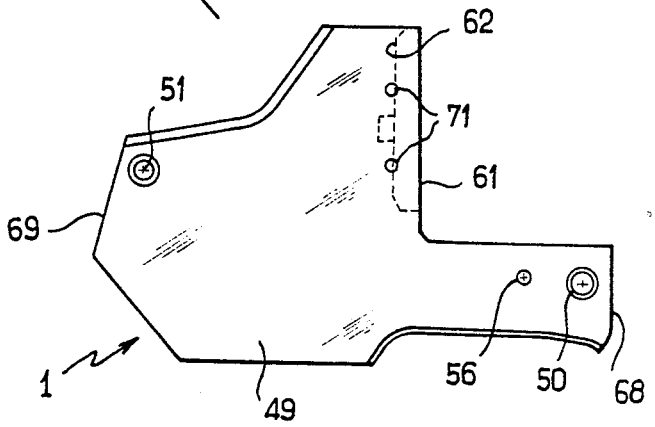

FIGS. 6 and 7 show how the mechanism carrier plate can easily be accurately positioned on the revolver frame. A mechanism carrier plate 1 in accordance with the invention has three transverse reference facettes: in this case there are two end facettes 68 and 69 and a central facette which is constituted by the rear face 62 of the above-described backing portion. It may be observed that the facettes 62 and 68 are substantially parallel but that the end facette 69 is at an angle to said common direction.

The frame 2 has transverse bearing surfaces 62', 68', and 69' corresponding to the reference transverse facettes (with corresponding reference numerals distinguished by the prime symbol being used for corresponding items on the frame). These three facettes and associated transverse bearing surfaces serve to ensure that the carrier plate together with the subassemblies mounted thereon is exactly positioned on the revolver frame.

The revolver frame has blind holes 54', 53', and 56' which correspond to the holes 54, 53, and 56 in the carrier plate, together with two tapped holes 50' adn 51' for engaging the fixing screws 47 and 46 respectively.

It has just been shown that the mechanism carrier plate is accurately positioned in its own plane. As for the transverse positioning of said plate, this is provided, in part, by the various mechanism pivots. It may be advantageous to provide a bearing face at the top of the carrier plate in order to improve positioning accuracy, and this is readily obtained by means of the inside face 70 of the first portion 57 of the projecting block 33, with said face constituting a bearing face, whereby the plate 1 together with the subassemblies mounted thereon can be positioned against the frame 2.

It may be observed that the frame 2 has parallel side faces, and that the outside face 49 of the carrier plate is also lacking in projections when it is assembled. It is thus possible to position and adjust the various functional subassemblies very accurately. Once adjustment and assembly have been completed, the projecting portions are then added, i.e. the release button 42 is snapped onto the cylinder release which has a projecting forked portion, and on the other side the side piece 43 is fixed (for example by means of screws whose ends are received in tapped holes 71 provided in the outside face of the carrier plate as shown in FIG. 7).

Figure 8:
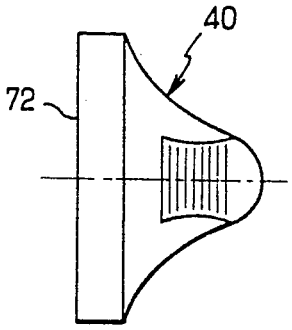
FIG. 8 is a side view of the cylinder release button which co-operates from the outside with the subassembly (visible in FIG. 1) associated with the cylinder release.
Figure 9:
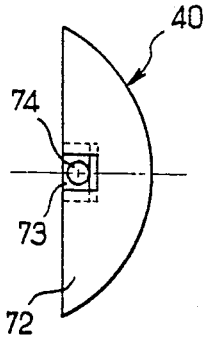
FIGS. 9 to 11 are respectively a first end view, an opposite end view and a plan view of the FIG. 8 cylinder release button.
Figure 10:
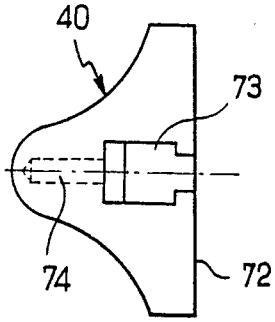
Figure 11:
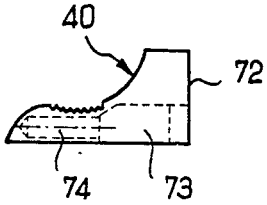
Figure 12:
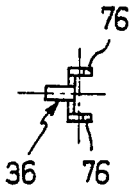
FIGS. 12 to 15 are respectively a first side view, a front view, a second side view, and a plan view of the cylinder release which is operated from the outside of the cylinder release button of FIGS. 8 to 11.
Figure 13:
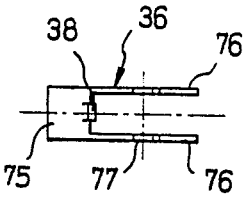
Figure 14:
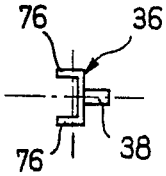
Figure 15:
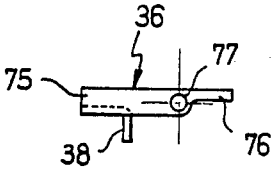

For greater clarity, FIGS. 8 and 11 show further details of the structure of the release button 40. It has a front face 72 which is substantially in the form of a segment of a cirlce and which, in the normal position of the release button, is level with the front face 61 of the backing portion, and with the front face of the add-on side piece 43. A substantially circular backing face is thus obtained serving to retain the cartridges in a loaded cylinder. A slot 73 is provided on the inside face of the release button for receiving the fork-shaped end of the cylinder release 36, said slot opening out forwardly and being extended rearwardly by a blind hole 74 for receiving the smooth end of the release button pin 41.

FIGS. 12 to 15 illustrate the cylinder release 36 in greater detail which is easily manufactured by cutting out and folding a flat piece of metal. It has a central portion 75 with the active tongue 38 projecting from the plane thereof, said central portion being extended by two tines 76 constituting a fork with the tips of the tines being received in the above-mentioned slot 73. The release 36 also has two holes 77 for receiving the release pivot 37.

It can now easily be understood how the mechanism carrier plate 1 fitted with the various functional subassemblies is capable of being mounted directly in the frame 2 as represented by arrow 48 in FIGS. 6 and 7.

Figure 16:
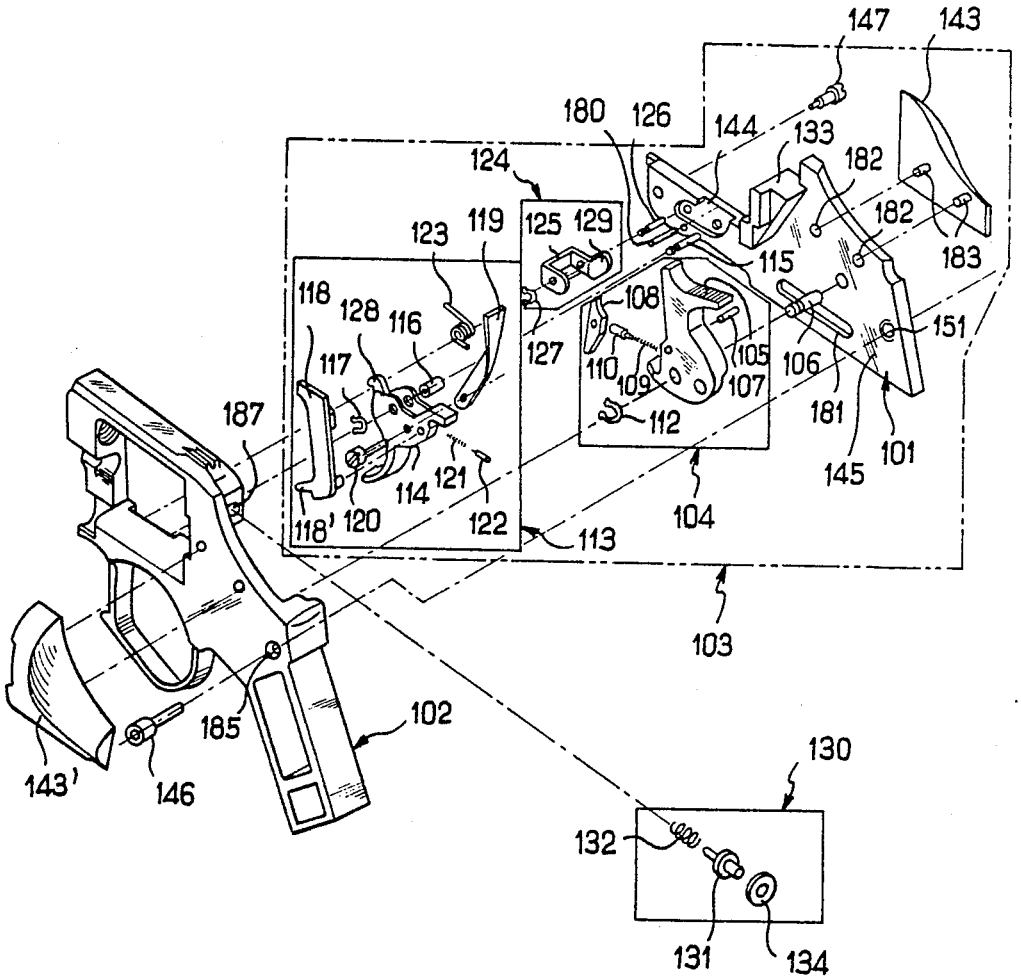
FIG. 16 is an exploded perspective view showing another mechanism carrier plate in accordance with a second variant of the invention and including the functional subassemblies associated with the hammer, with the trigger, and with the cylinder latch, but with the firing pin being integrated in the frame of the revolver.

The exploded view of FIG. 16 illustrates a variant of the invention in which the mechanism carrier plate only receives the functional subassemblies associated with the hammer, with the trigger, and with the cylinder latch. In this case, and unlike the above-described variant, the subassembly associated with the firing pin is integrated in the revolver frame. Further, in this variant, there is no subassembly associated with the cylinder release, with the cylinder crane being latched to the frame by any conventinal meaans (for example analogous to those described in U.S. Pat. No. 678,274).

For the purposes of simplification, members analogous to those already described with respect to the preceding variant have the same reference numerals plus 100.

The functional moving part assembly 103 thus comprises subassemblies associated with the hammer (subassembly 104), with the trigger (subassembly 113), and with the cylinder latch (subassembly 124). As before, the mechanism carrier plate 101 receives these functional subassemblies directly, thereby providing extremely favorable accessibility for the operations of machining, assembly, and adjustment.

Figure 17:
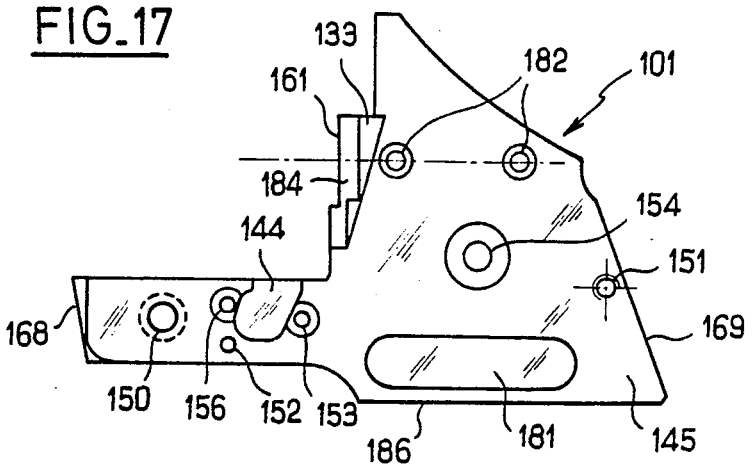
FIG. 17 is a side view, on a larger scale of the above mechanism carrier plate.
Figure 18:
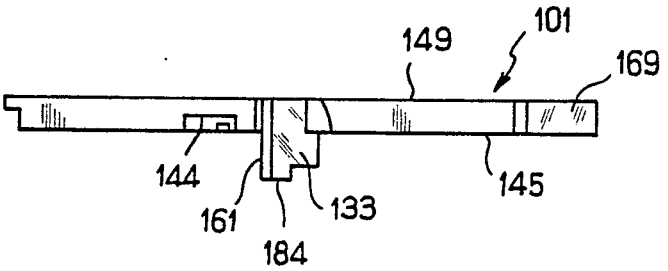
FIG. 18 to 20 are respectively a plan view and first and second end views of the FIG. 17 plate.
Figure 19:
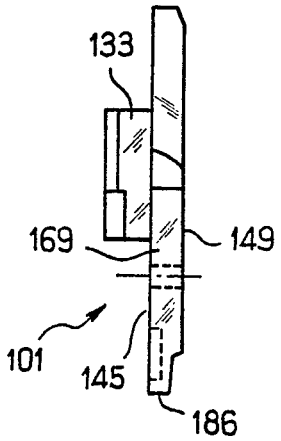
Figure 20:
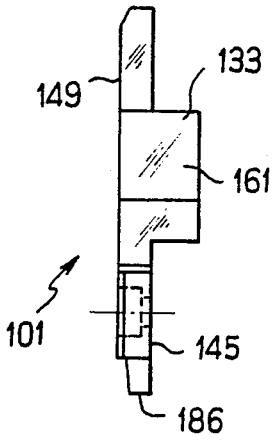

Subassemblies 104 and 124 are identical to above-described subassemblies 4 and 24. As for subassembly 113, a pin 180 received in a hole 152 in the carrier plate (FIG. 17) may be observed, said pin serving to hold one of the branches of the trigger spring 123. It may also be observed that the cylinder pawl 118 and the striker lever 119 have been interchanged in position: this makes it possible to avoid the complex machining of the slot 67 in the previous variant, leaving the cylinder pawl 118 to pass through a space delimited by a projecting backing block 133 for the cylinder (i.e. the inside face 184 of said block) and the facing inside face of the frame. The pivot 120 of the striker lever 119 is also swapped-over. It may be observed that initial adjustment may be obtained by providing said pivot with an excentric head against which the bottom lug 118' of the cylinder pawl 118 comes into abutment, thereby enabling the rest position of said cylinder pawl to be adjusted during assembly (prior to final fixing) merely by rotating the pivot 120.

A subassembly 130 associated with the firing pin can also be seen, and this subassembly is mounted in the frame 102 of the revolver. The firing pin 131 and its spring 132 are mounted in a stepped bore 118 in the frame (see FIG. 21) and the subassembly is held in place by inserting a washer 134 which is clamped in a countersunk hole 187 concentric with the firing pin housing.

FIG. 16 also shows two side pieces 143 and 143' which are fixed respectively to the mechanism carrier plate 101 and to the frame 102. Piece 143 has two pegs 183 which are received in associated holes 182 in the plate and then not riveted by crushing the ends thereof.

The structure of the mechanism carrier plate 101 can be seen more clearly with reference to FIGS. 17 to 20.

It may be observed, in particular, that the projecting block 133 is simpler in design than the stepped projecting block 33 of the preceding variant: in this case the block 133 serves solely as a backing for the cylinder via its front face 161, with the function of supporting the firing pin and providing a backing for the cartridge being fired now being provided by the frame (or by a part mounted on the frame). The inside face 184 of the block 133 serves, conjunction with the facing portion of the frame, to define a space allowing the top end of the cylinder pawl 118 to move freely.

The various holes in the plate 101 are summarized below: a stepped hole 150 for fixing screw 147, holes 156, 152, 153, and 154 for pivot 126, pin 180, and pivots 115 and 106 (with a stepped-back region 144 for the cylinder latch 125), holes 182 for the pegs 183 of the associated side piece, and tapped hole 151 for fixing screw 146 (which screw has a cylindrical head with a hex socket and passes through an associated hole 185 in the frame, as can be seen in FIG. 16). The purely optionally stepped-back region 181 may be used for positioning purposes if it is desired to mount a different subassembly, thereby providing a reference which is parllel to the axis of the barrel.

Like FIGS. 6 and 7, FIGS. 21 and 22 show how the mechanism carrier plate 101 can be positioned exactly. However, unlike the preceding variant, only two transverse reference facettes 169 and 186 are used for the mechanism carrier plate 101 (constituting the rear and bottom edges of the plate), with said facettes co-operating with corresponding transverse bearing surfaces 169' and 186' provided on the frame 102. In this variant, clearance is provided between the front end facette 168 and the associated transverse surface 168' (with the sloping edge merely serving to cover the join).

It may be observed that the facette 161' of the frame 102 (FIG. 21) provides a backing function in this case for the cartridge being fired, whereas this function was provided in the preceding variant by the stepped projecting block on the mechanism carrier plate.

The various holes in the frame 102 as seen from the inside are as follows: hole 185 and tapped hole 150' for fixing screws 146 and 147, holes 182' for the pegs on side piece 143', and blind holes 153' and 156' which correspond to holes 153 and 156.

It has already been mentioned that the mechanism carrier plate in accordance with the invention provides numerous advantages, and these new now summarized very briefly. Considerable accessibility for machining the carrier plate, and for adjusting and/or assembling the gun (the mechanism stands proud and is no longer inside a box as is the case in several prior mechanisms). Assembly is more easily automated without losing accuracy by virtue of it being possible to obtain accurate dimensions for the carrier plate, possibly including machining without requiring it to be disassembled. The transverse positioning of various members, and in particular of the cylinder drive pawl, is automatically achieved with accuracy so that the cylinder always rotates properly.

The design of the support device in accordance with the invention in the form of a mechanism carrier plate considerably reduces the role of the frame when compared with prior structures: in this case, the frame merely acts as an interface between the barrel, the cylinder, and the mechanism. The considerable cost of the frame in conventional designs is now shared between two pieces (the mechanism carrier plate and the revolver frame), thereby reducing the overall manufacturing cost.

The invention is not limited to the embodiments described above, but covers any variant which reproduces the essential characteristics of the accompanying claims, using equivalent means.

We claim:

1. A device for supporting a mechanism of a revolver in association with a frame of said revolver, the device being essentially constituted by a mechanism carrier plate, said plate:

firstly directly receiving various subassemblies of the mechanism, including a first subassembly associated with a hammer, a second subassembly associated with a trigger, and a third subassembly associated with a cylinder latch; and secondly being capable of being directly mounted together with the subassemblies supported thereby on the frame of the revolver.

2. A support device according to claim 1, wherein the mechanism carrier plate also receives a fourth subassembly associated with a firing pin.

3. A support device according to claim 1, wherein the mechanism carrier plate also receives a fifth subassembly associated with a cylinder release.

4. A support device according to claim 1, wherein the mechanism carrier plate includes transverse reference facettes, which are associated with transverse bearing surfaces provided on the revolver frame, thereby enabling said plate together with the subassemblies carried thereby to be positioned exactly on said frame.

5. A support device according to claim 1, wherein the mechanism carrier plate directly receives the various subassemblies of the mechanism on its inside face, with the outside face of the plate completing the corresponding side face of the frame such that said plate also constitutes a side plate.

6. A support device according to claim 2, wherein the mechanism carrier plate has a stepped block at the top projecting from its inside, face with a first portion of the block adjacent to the inside face of the plate serving to receive the fourth assembly associated with the firing pin, and with a second portion thereof coming into abutment via its rear face against the frame when said plate is mounted thereon, the front face of said projecting block providing backing for the revolver cylinder and for the cartridge being fired.

7. A support device according to claim 6, for a revolver whose mechanism includes a fifth subassembly associated with a cylinder release, wherein the projecting block carries a one-piece shelf projecting rearwardly, said shelf being suitable firstly for directly receiving said subassembly associated with the cylinder release, and secondly, when said plate is mounted in the frame, for supporting an external release button connected to the cylinder release and enabling the moving of said cylinder release by actuating said external release button.

8. A support device according to claim 6, wherein the mechanism carrier plate includes transverse reference facettes, which are associated with transverse bearing surfaces provided on the revolver frame, thereby enabling said plate together with the subassemblies carried thereby to be positioned exactly on said frame, and wherein the rear face of the second portion of the projecting block constitutes one of the transverse reference facettes, with the other two facettes being constituted by a front end edge and a rear end edge of the plate.

9. A support device according to claim 6, wherein the inside face of the first portion of the projecting block constitutes a bearing surface, whereby the plate together with the subassemblies it supports, may be positioned to bear against the frame.

10. A support device according to claim 6, wherein the mechanism carrier plate has, on its inside, a plane center region which is set-back relative to a plane face from which the stepped projecting block projects, thereby defining a guide slot for providing transverse positioning for at least some of the members of the mechanism, and in particular for a cylinder drive pawl.

11. A support device according to claim 10, wherein the said plate is generally L-shaped in side view, with the set-back center region also being generally L-shaped, and with both L-shapes sharing a common right angle.

12. A support device according to claim 5, wherein the mechanism carrier plate has a plurality of holes in its inside face which holes extend substantially perpendicularly to said inside face, said holes being for the purpose of supporting the main pivots and pins of the mechanism, in particular the hammer pivot, the trigger pivot, and the cylinder latch pivot, with the holes associated with the hammer and the trigger pivots being preferably blind holes.

13. A support device according to claim 12, wherein the mechanism carrier plate also receives a fourth assembly associated with a firing pin, wherein the mechanism carrier plate has a stepped projecting block at the top and on its inside, with a first portion of the block adjacent to the inside face of the plate serving to receive the fourth assembly associated with the firing pin, and with a second portion thereof coming into abutment via its rear face against the frame when said plate is mounted thereon, the front face of said projecting block providing backing for the revolver cylinder and for the cartridge being fired, and wherein the projecting block of the mechanism carrier plate includes a plurality of holes extending substantially to the inside face of said plate, said holes serving to receive longitudinally slidable members, in particular the firing pin, an axial pin of the cylinder and a tongue of a cylinder release adjacent thereto, and an axial pin for guiding an external release button connected to said cylinder release.

14. A support device according to claim 13, wherein the axes of said holes occupy two orthogonal reference planes which intersect on the axis of the cylinder.

15. A support device according to claim 1, associated with a revolver frame receiving a subassembly associated with a firing pin, wherein the mechanism carrier plate has a projecting block near its top and on its inside face, with the front face of the block constituting a backing face for the cylinder of the revolver.

16. A support device according to claim 15, wherein the projecting block defines, together with the frame a space for passing the end of a cylinder pawl which, in this case, is disposed between the revolver trigger and said frame.

17. A support device according to claim 15, wherein the mechanism carrier plate includes a plurality of holes on its inside face, said holes extending substantially perpendicularly to said inside face and serving to support the main pivots and pins of the mechanism, and in particular the hammer pivot, the trigger pivot, and the cylinder latch pivot, and preferably also a pin serving as a bearing surface for a return spring of the revolver trigger.

18. A support device according to claim 5, wherein the mechanism carrier plate supports a side piece on its outside face, said side piece acting as a backing face for cartridges, said side piece being added to said plate so that the outside face of said plate is plane for facilitating the operations of machining the plate and of mounting and/or adjusting the various subassemblies of the mechanism which are mounted directly on said plate.

* * * * *